US009766026B2

(12) United States Patent
Hirt et al.

(10) Patent No.: US 9,766,026 B2
(45) Date of Patent: Sep. 19, 2017

(54) GAS OPERATING SYSTEM FOR AN AUTOMATIC PISTOL-CALIBER FIREARM

(71) Applicant: Sig Sauer, Inc., Newington, NH (US)

(72) Inventors: Robert Hirt, Exeter, NH (US); Christopher Sirois, Newfields, NH (US)

(73) Assignee: SIG SAUER, INC., Newington, NH (US)

( * ) Notice: Subject to any disclaimer, the term of this patent is extended or adjusted under 35 U.S.C. 154(b) by 866 days.

(21) Appl. No.: 14/058,948

(22) Filed: Oct. 21, 2013

(65) Prior Publication Data

US 2017/0234634 A1 Aug. 17, 2017

(51) Int. Cl.
*F41A 5/18* (2006.01)

(52) U.S. Cl.
CPC ..... *F41A 5/18* (2013.01)

(58) Field of Classification Search
CPC ..... F41A 5/18; F41A 5/26; F41A 5/28
USPC ..... 89/191.01, 191.02, 192, 193
See application file for complete search history.

(56) References Cited

U.S. PATENT DOCUMENTS 1,803,523 A * 5/1931 Conlon ..... F41A 25/02 89/177
2,035,539 A * 3/1936 Dicke ..... F41A 3/26 42/16
2,865,256 A * 12/1958 Marsh ..... F41A 3/62 89/191.01
3,359,860 A * 12/1967 Mühlemann ..... F41A 5/26 89/193
4,611,525 A * 9/1986 Bosshard ..... F41A 5/28 89/193
4,619,184 A * 10/1986 Shalev ..... F41A 3/86 89/185
5,945,626 A 8/1999 Robbins
2011/0271827 A1* 11/2011 Larson ..... F41A 5/28 89/193
2012/0167757 A1 7/2012 Gomez
2012/0317860 A1 12/2012 Langevin et al.

* cited by examiner

*Primary Examiner* — Bret Hayes
(74) *Attorney, Agent, or Firm* — Finch & Maloney PLLC

(57) ABSTRACT

A gas operating system for automatic cycling of a pistol-caliber firearm is disclosed. The disclosed system may be configured to utilize gas produced by combustion of pistol cartridge propellant to automatically cycle the firearm. To that end, the disclosed system may include a gas block which routes high-pressure gas from the barrel through a gas port to a piston. The location of the gas port may be selected to lie within a region of the barrel which generally corresponds with the peak of the pressure curve associated with a given pistol cartridge. The high-pressure gas may impinge on the piston head, forcing the piston rearward and into physical contact with a short-stroke operating rod affixed to the bolt carrier of the host firearm. Consequently, the bolt carrier may be driven rearward, allowing for cycling of the firearm to progress.

23 Claims, 8 Drawing Sheets

GAS OPERATING SYSTEM FOR AN AUTOMATIC PISTOL-CALIBER FIREARM

FIELD OF THE DISCLOSURE

The present disclosure relates to firearms and more particularly to pistol-caliber firearms configurable with automatic-firing capabilities.

BACKGROUND

Firearm design involves a number of non-trivial challenges, and compact firearms platforms have faced particular complications, such as those with respect to achieving automatic-firing capabilities. Continued platform scaling will make these challenges even greater.

SUMMARY

One example embodiment provides a gas operating system for a pistol-caliber firearm, the system including: a gas block having a piston disposed therein and configured to divert a volume of gas from a barrel of the firearm to the piston, the volume of gas produced during discharge of a pistol cartridge chambered by the firearm; and an operating rod connected to a bolt carrier of the firearm and configured to be driven rearward by the piston upon impingement on the piston of the diverted volume of gas, wherein rearward movement of the operating rod and connected bolt carrier automatically cycles the firearm. In some cases, the gas block is formed as a unitary component. In some cases, the piston has a piston head diameter in the range of about 0.25-0.75 inches. In some instances, the piston has a stroke length in the range of about 5-15 mm. In some instances, the operating rod has a total length in the range of about 1.5-3.0 inches. In some cases, the operating rod is vertically offset from the bolt carrier. In some instances, the system further includes a gas regulator configured to adjust a flow of the diverted volume of gas from the barrel to the piston. In some such instances, the gas regulator comprises a one-way/check valve. In some cases, the barrel of the firearm has a length in the range of about 4-10 inches. In some cases, the firearm is chambered for at least one of 9 mm caliber rounds, .357 SIG caliber rounds, and/or .40 caliber (10×22 mm) rounds. In some instances, the volume of gas is less than that produced by an assault rifle cartridge. In some cases, the firearm comprises a submachine gun.

Another example embodiment provides a gas operating system for automatic cycling of a pistol-caliber firearm, the system including: a gas block including: a body portion; a lower channel formed in the body portion and configured to receive a barrel of the firearm; an upper channel formed in the body portion and positioned above the lower channel, the upper channel having a piston disposed therein; and a gas flow path configured to provide fluid communication between the lower and upper channels; and an operating rod connected with a bolt carrier of the firearm and configured to be incident with the piston; wherein the system is configured to divert gas from the barrel of the firearm along the gas flow path to impinge on the piston, thereby driving the operating rod and connected bolt carrier rearward to cycle the firearm. In some cases, the gas flow path is provided at a location with respect to the gas block which corresponds with a pressure curve peak associated with at least one of a 9 mm caliber cartridge, a .357 SIG caliber cartridge, and/or a .40 caliber (10×22 mm) cartridge. In some instances, the gas flow path is provided at a location with respect to the gas block that is in the range of about 1-10 mm from a case mouth of a pistol cartridge chambered by the firearm. In some cases, the gas flow path comprises a passageway formed in the body portion of the gas block and aligned with a gas port formed in a sidewall of the barrel received by the firearm. In some such cases, the passageway has a width/diameter that is greater than or equal to a width/diameter of the gas port. In some other such cases, the gas port has a width/diameter in the range of about 0.75-2.0 mm. In some instances, the system further comprises a valve disposed within the upper channel, the valve configured to vent to a surrounding environment during a return stroke of the piston.

Another example embodiment provides an automatic pistol-caliber firearm including: a barrel having a gas port; a bolt carrier; and a gas operating system including: a gas block having a passageway formed therein which aligns with the gas port of the barrel to provide a gas flow path from the barrel to a piston disposed within the gas block along the gas flow path; and an operating rod connected with the bolt carrier and configured to transfer a force of a gas volume impinging on the piston to the bolt carrier to automatically cycle the firearm. In some cases, the bolt carrier includes a rotating bolt disposed therein. In some instances, the firearm comprises a submachine gun chambered for at least one of 9 mm caliber rounds, .357 SIG caliber rounds, and/or .40 caliber (10×22 mm) rounds. In some cases, the barrel has a length in the range of about 4-10 inches. In some instances, the gas port is formed within a barrel extension of the barrel, the barrel extension configured to be inserted within the gas block.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

Figure 1A:
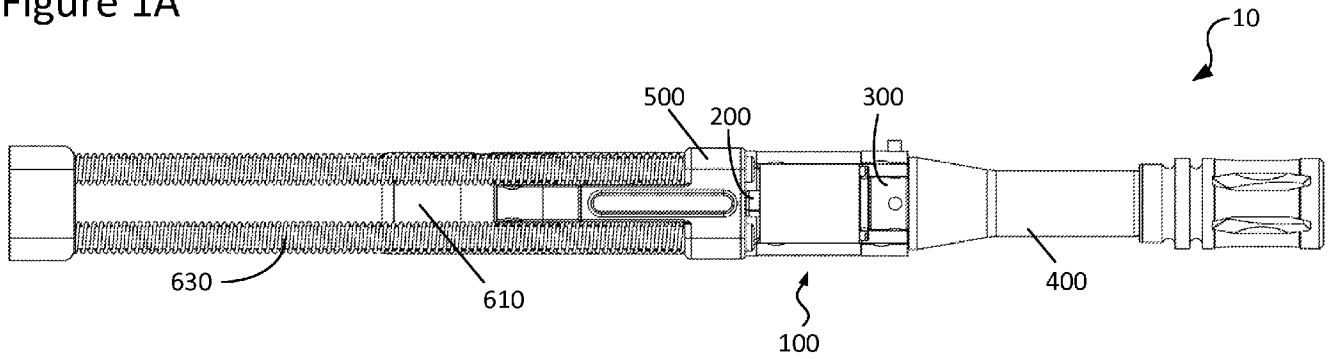
FIGS. 1A and 1B are a top view and a cross-sectional side view, respectively, of a gas operating system for a firearm, configured in accordance with an embodiment of the present disclosure.

These and other features of the present embodiments will be understood better by reading the following detailed description, taken together with the figures herein described. In the drawings, each identical or nearly identical component that is illustrated in various figures may be represented by a like numeral. For purposes of clarity, not every component may be labeled in every drawing. Furthermore, as will be appreciated, the figures are not necessarily drawn to scale or intended to limit the claimed invention to the specific configurations shown. In short, the figures are provided merely to show example structures.

DETAILED DESCRIPTION

A gas operating system for automatic cycling of a pistol-caliber firearm is disclosed. In accordance with some embodiments, the disclosed system may be configured to utilize gas produced by combustion of pistol cartridge propellant to automatically cycle the firearm. To that end, and in accordance with some embodiments, the disclosed system may include a gas block which routes high-pressure gas from the barrel through a gas port to a piston. The location of the gas port may be selected to lie within a region of the barrel which generally corresponds with the peak of the pressure curve associated with a given pistol cartridge, in some embodiments. The high-pressure gas may impinge on the piston head, forcing the piston rearward and into physical contact with a short-stroke operating rod affixed to the bolt carrier of the host firearm, in accordance with some embodiments. Consequently, the bolt carrier may be driven rearward, allowing for cycling of the firearm to progress. Numerous configurations and variations will be apparent in light of this disclosure.

General Overview

Submachine guns that utilize a straight blowback operating system for firing cycle automation lack a locking breech. These systems can be unsafe in extreme conditions and are susceptible to catastrophic failure in the event of a barrel obstruction. In addition, straight blowback operating systems are dirty and generate significant recoil during automatic firing, making the host firearm difficult to control (e.g., disrupting the point of aim). Submachine guns that utilize a delayed/retarded blowback operating system for firing cycle automation have an additional degree of mechanical complexity which requires additional high-precision componentry, increases cost, and increases the difficulty of system maintenance. Existing submachine guns do not utilize piston-based gas operating systems due to, for example, the reduced pressures and shortened pressure curves offered by pistol cartridges.

A gas operating system for automatic cycling of a pistol-caliber firearm is disclosed. During the discharge of a pistol cartridge, a volume of gas is produced by combustion of the pistol cartridge propellant. In accordance with some embodiments, the disclosed gas operating system may be configured to utilize that gas volume, at least in part, to automatically cycle a host firearm. To that end, and in accordance with some embodiments, the disclosed system may include a gas block which routes high-pressure gas from the barrel through a gas port to a piston. The location of the gas port may be selected so as to lie within a region of the barrel which generally corresponds with the peak of the pressure curve associated with a given pistol cartridge, in some embodiments. The high-pressure gas may impinge on the piston head, forcing the piston rearward and into physical contact with a short-stroke operating rod affixed to the bolt carrier of the host firearm, in accordance with some embodiments. Consequently, the bolt carrier may be driven rearward, allowing for cycling of the firearm to progress, in accordance with some embodiments.

The disclosed gas operating system can be configured, in accordance with some embodiments, to be compatible for use with a wide range of pistol cartridges, including, for example: 9 mm caliber rounds; .357 SIG caliber rounds; and/or .40 caliber (10×22 mm) rounds. In accordance with some embodiments, the disclosed gas operating system can be configured, for example, to utilize a volume of gas for cycling a host firearm that is less than that produced by an assault rifle cartridge, such as the 7.62×39 mm. Other types of pistol cartridges with which the disclosed gas operating system may be compatible will be apparent in light of this disclosure.

In some embodiments, the disclosed system may help to improve the reliability of operation of the host firearm, for example, in adverse environmental conditions and hazards which may be encountered in the field, such as mud, dirt, sand, water, and cold temperatures. Also, in some instances, a gas operating system provided using the disclosed techniques can be configured, for example, as: (1) a partially/completely assembled gas operating system unit or a firearm integrating such unit; and/or (2) a kit or other collection of discrete components (e.g., gas block, piston, gas regulator assembly, operating rod, etc.) which may be operatively coupled as desired to provide a host firearm with automatic firing capabilities.

System Architecture

Figure 1B:
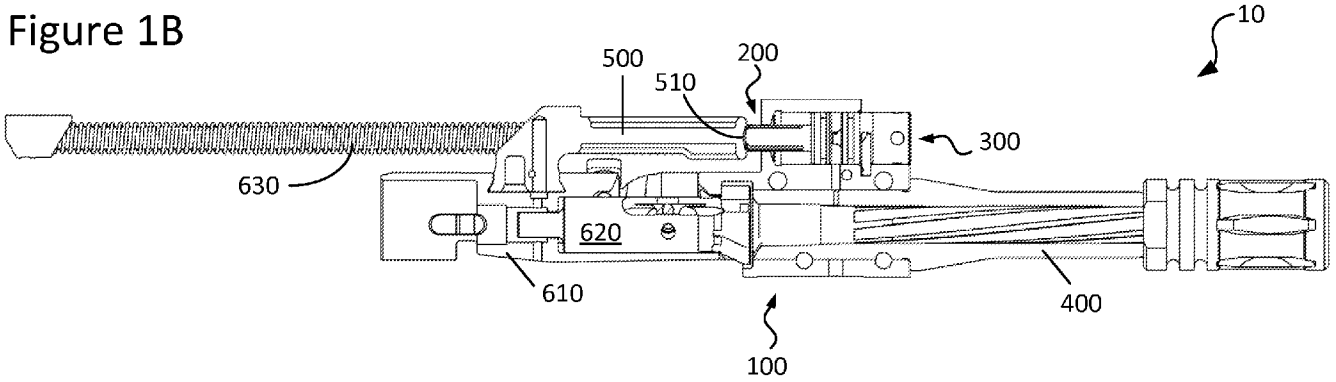

FIGS. 1A and 1B are a top view and a cross-sectional side view, respectively, of a gas operating system 10 for a firearm, configured in accordance with an embodiment of the present disclosure. As can be seen, gas operating system 10 includes a gas block 100 configured, for example, to host a piston 200, a gas regulator assembly 300, and a barrel 400. Also, gas operating system 10 includes an operating rod 500 configured, for example, to be operatively coupled with the bolt carrier 610 and one or more recoil springs 630 of a host firearm. As discussed herein, and in accordance with some embodiments, gas operating system 10 may operate to bring piston 200 and operating rod 500 into physical contact with one another, for example, for purposes of driving bolt carrier 610 rearward to cycle a host firearm.

Figure 2A:
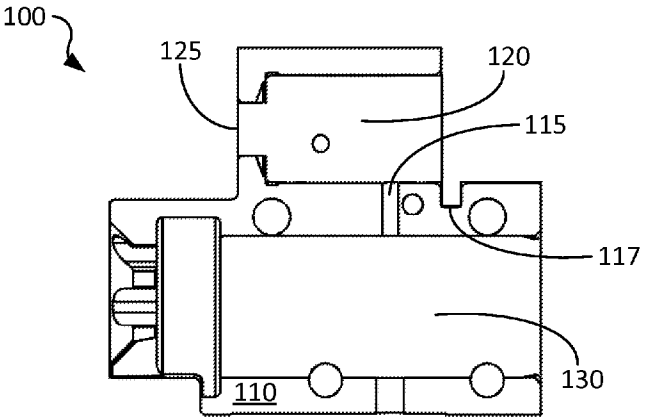
FIG. 2A is a cross-sectional view of a gas block configured in accordance with an embodiment of the present disclosure.
Figure 2B:
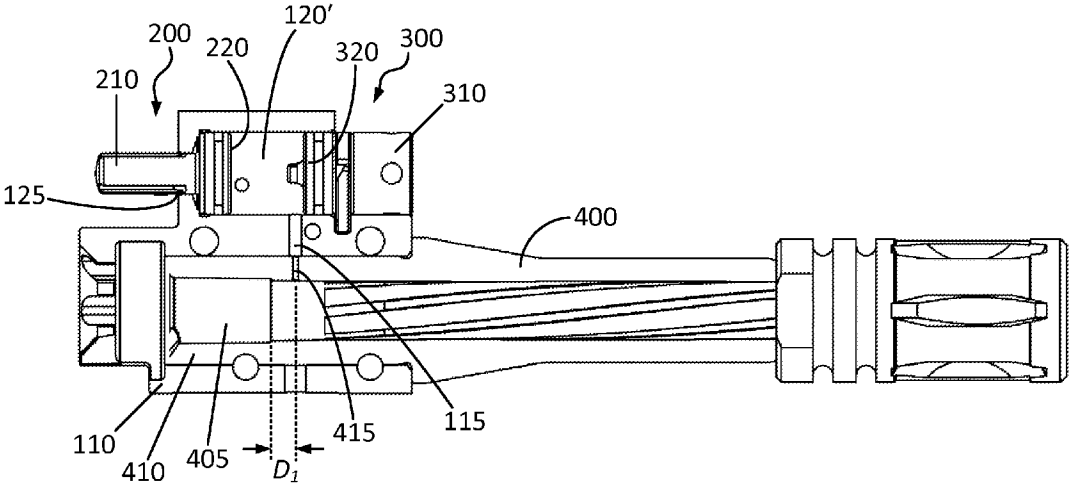
FIG. 2B is a cross-sectional view of the gas block of FIG. 2A hosting a piston, a gas regulator assembly, and a barrel, in accordance with an embodiment of the present disclosure.

FIG. 2A is a cross-sectional view of a gas block 100 configured in accordance with an embodiment of the present disclosure, and FIG. 2B is a cross-sectional view of the gas block 100 of FIG. 2A hosting a piston 200, a gas regulator assembly 300, and a barrel 400. Gas block 100 can be operatively coupled with a firearm and configured to deliver a flow of high-pressure gas from a discharged pistol cartridge to piston 200, in accordance with some embodiments. As can be seen, gas block 100 includes a body portion 110 having a piston-receiving channel 120 (i.e., an upper channel) and a barrel-receiving channel 130 (i.e., a lower channel) formed therein. As can be seen further, a passageway 115 is formed in body portion 110 and configured to provide a fluid pathway between piston-receiving channel 120 and barrel-receiving channel 130. In addition, an aperture 125 is formed in body portion 110 at the rear of the piston-receiving channel 120, and a recess 117 is formed in body portion 110 at the forward end thereof.

The dimensions (e.g., length, width, height, wall thicknesses, mass, etc.) of gas block 100 can be customized for a given target application or end-use. Also, gas block 100 can be constructed from any suitable material(s). For example, in some embodiments, gas block 100 can be constructed from AISI 9310 stainless steel. In some other embodiments, gas block 100 can be constructed, for example, from carbon steel. As will be appreciated in light of this disclosure, it may be desirable in some instances to ensure that gas block 100 comprises a material (or combination of materials), for example, which is corrosion-resistant, reliable over a wide temperature range (e.g., −50° F. to 170° F.), and/or resistant to deformation, fracture, and/or cyclic fatigue (e.g., heat-treated). In a more general sense, gas block 100 can be constructed from any suitable material which is compliant, for example, with United States Defense Standard MIL-W-13855 (Weapons: Small Arms and Aircraft Armament Subsystems, General Specification For).

In some embodiments, gas block 100 may be formed as a unitary component; that is, body portion 110 may be a one-piece component (e.g., formed from a single piece of material to provide a single, continuous element). In some other embodiments, however, gas block 100 may be an assembly of separate pieces which are operatively coupled with one another; that is, body portion 110 may be multiple distinct pieces which are attached to or otherwise assembled with one another (e.g., such as by welding, riveting, or other suitable technique for joining portions of gas block 100). Other suitable configurations for gas block 100 will depend on a given application and will be apparent in light of this disclosure.

As can be seen from FIG. 2B, piston 200 may be disposed, at least in part, within piston-receiving channel 120, in accordance with some embodiments. In some cases, piston 200 may be configured such that its piston head 220 resides within piston-receiving channel 120 between aperture 125 and valve 320 of gas regulator assembly 300, and its piston body 210 extends from piston-receiving channel 120 through aperture 125 formed in body portion 110 of gas block 100. In accordance with some embodiments, aperture 125 may be dimensioned, for example, to accommodate piston body 210 without undesirably hindering movement of piston 200 within piston cylinder 120', while also preventing piston head 220 from passing through aperture 125.

The dimensions of piston 200 can be customized for a given target application or end-use. In some embodiments, piston body 210 may have a length, for example, in the range of about 10-50 mm (e.g., about 10-30 mm, about 30-50 mm, or any other sub-range in the range of about 10-50 mm). In some embodiments, piston head 220 may have a width/diameter, for example, in the range of about 0.25-0.75 inches (e.g., about 0.375-0.625 inches, or any other sub-range in the range of about 0.25-0.75 inches). In a more general sense, the dimensions of piston 200 may be customized, for example, to provide for the desired physical interfacing between piston 200 and operating rod 500, and/or to provide for the desired amount of force for thrusting operating rod 500 rearward, as discussed herein.

Also, piston 200 can be constructed from any suitable material(s). For example, in some embodiments, piston 200 can be constructed from a stainless steel. As will be appreciated in light of this disclosure, it may be desirable in some instances to ensure that piston 200 comprises a material (or combination of materials), for example, which is corrosion-resistant, reliable over a large temperature range (e.g., −50° F. to 170° F.), and/or resistant to deformation, fracture, and/or cyclic fatigue (e.g., heat-treated). In a more general sense, piston 200 can be constructed from any suitable material which is compliant, for example, with United States Defense Standard MIL-W-13855 (Weapons: Small Arms and Aircraft Armament Subsystems, General Specification For).

In accordance with some embodiments, piston 200 may be permitted to move forward and rearward within piston cylinder 120' during a given firing cycle. The range of forward and rearward motion (i.e., the stroke length) of piston 200 can be customized for a given target application or end-use. In some embodiments, piston 200 may be provided with a stroke length, for example, in the range of about 5-15 mm (e.g., about 5-10 mm, about 8-12 mm, about 10-15 mm, or any other sub-range in the range of about 5-15 mm). It should be noted, however, that greater and/or lesser stroke lengths can be provided for piston 200 as desired, in accordance with other embodiments. Other suitable configurations for piston 200 will depend on a given application and will be apparent in light of this disclosure.

In accordance with some embodiments, gas regulator assembly 300 may be configured to aid in regulating the amount of high-pressure gas that is used to cycle a host firearm and/or to help ensure that sufficiently high gas pressure is present to provide for the desired gas-based operation of the host firearm. Also, gas regulator assembly 300 may be configured, in accordance with some embodiments, to vent to the ambient environment during the return stroke of piston 200 within piston cylinder 120', thereby helping to prevent or otherwise reduce return of the diverted gas volume back into bore 405 of barrel 400. To these ends, gas regulator assembly 300 may include an adjustment mechanism 310 and a valve 320, in accordance with some embodiments.

In some embodiments, adjustment mechanism 310 may reside, at least in part, within piston-receiving channel 120 and within the recess 117 formed in body portion 110 adjacent to piston-receiving channel 120, towards the forward end of gas block 100. Adjustment mechanism 310 may be configured, for example, to allow an operator to adjust the gas-based operation settings of the host firearm; that is, the operator may manipulate adjustment mechanism 310 to select the desired flow of gas to achieve the desired performance from the host firearm, in accordance with some embodiments. Also, valve 320 may be disposed within piston-receiving channel 120 such that the remaining interior volume of piston-receiving channel 120 serves as the piston cylinder 120' in which piston 200 operates, in accordance with some embodiments.

In some embodiments, valve 320 may be configured, for example, to function as a one-way/check valve that allows gas to pass through it and out of gas block 100. To that end, valve 320 may include, in some embodiments, a venting aperture having a diameter/width, for example, in the range of about 0.5-1.5 mm (e.g., about 0.8-1.2 mm, or any other sub-range in the range of about 0.5-1.5 mm). Other suitable configurations for gas regulator assembly 300 will depend on a given application and will be apparent in light of this disclosure.

As previously noted, gas block 100 may be configured to receive and retain a barrel 400. In particular, barrel extension 410 of barrel 400 may be inserted within barrel-receiving channel 130 of gas block 100. The dimensions (e.g., length, diameter/width, mass, etc.) and geometry of barrel 400 can be customized as desired for a given target application or end-use. In some cases, barrel 400 may have a length in the range of about 4-10 inches (e.g., about 4-6 inches, about 6-8 inches, about 8-10 inches, or any other sub-range in the range of about 4-10 inches). In some instances, bore 405 of barrel 400 may be rifled.

In accordance with some embodiments, barrel 400 may have a gas port 415 formed, for example, in the sidewall of its barrel extension 410. In some such cases, gas port 415 may be formed within barrel extension 410 such that, when barrel 400 is operatively coupled with gas block 100, gas port 415 substantially aligns with passageway 115 formed in body portion 110 of gas block 100. The dimensions (e.g., width/diameter, length, etc.) and geometry of gas port 415 can be customized for a given target application or end-use. In some embodiments, gas port 415 may have a width/diameter, for example, in the range of about 0.75-2.0 mm (e.g., about 1.0-1.4 mm, or any other sub-range in the range of about 0.75-2.0 mm). In some embodiments, gas port 415 may have a cylindrical geometry (e.g., circular cross-section, elliptical cross-section). In some other embodiments, gas port 415 may have a prismatic geometry (e.g., rectangular/square cross-section). In some other embodiments, gas port 415 may have a conical or pyramidal geometry (e.g., conical frustum, pyramidal frustum). In a more general sense, and in accordance with some embodiments, gas port 415 may be provided with any suitable dimensions and geometry that allow for flowing therethrough of a volume of gas that is sufficient to cycle the host firearm.

Also, the location of gas port 415 can be customized for a given target application or end-use. In some instances, it may be desirable to ensure that gas port 415 is located as closely as practically possible to the case mouth of a chambered pistol cartridge to ensure that the gas from the discharged cartridge is obtained at or near the peak of the pressure curve for delivery to piston cylinder 120'. In some embodiments, gas port 415 may be located relative to the case mouth of a chambered pistol cartridge at a distance $D_1$, for example, in the range of about 1-10 mm (e.g., about 1-3 mm, about 3-5 mm, about 5-7 mm, about 7-9 mm, or any other sub-range in the range of about 1-10 mm). It should be noted, however, that the location of gas port 415 may depend, at least in part, on the length of barrel 400 and/or on the type(s) of pistol cartridges for which the host firearm is chambered. Other suitable configurations for barrel 400 and its gas port 415 will depend on a given application and will be apparent in light of this disclosure.

As previously noted, the passageway 115 formed in body portion 110 of gas block 100 may be configured, in accordance with some embodiments, to provide for fluid coupling of piston-receiving channel 120 and barrel-receiving channel 130. When barrel extension 410 is inserted within barrel-receiving channel 130, and gas port 415 is substantially aligned with passageway 115, the bore 405 of barrel 400 and the piston cylinder 120' of gas block 100 are in fluid communication with one another (e.g., a gas flow path is provided there between), in accordance with some embodiments.

The dimensions (e.g., width/diameter, length, etc.) of passageway 115 can be customized for a given target application or end-use. In some embodiments, the width/diameter of passageway 115 may be larger than or equal to the width/diameter of gas port 415 of barrel 400. Also, the location of passageway 115 can be customized for a given target application or end-use. In accordance with some embodiments, passageway 115 may be provided at a location that is complementary to that of gas port 415 (e.g., such that passageway 115 substantially aligns with gas port 415). Together, gas port 415 and passageway 115 may allow gas to travel from barrel 400 into piston cylinder 120'. Also, the location of passageway 115 may be selected, in accordance with some embodiments, such that gas is permitted to escape from barrel 400 at or near the peak of the gas pressure curve for delivery to piston cylinder 120'. Other suitable configurations for passageway 115 will depend on a given application and will be apparent in light of this disclosure.

Returning now to FIGS. 1A and 1B, operating rod 500 may be mechanically coupled with bolt carrier 610, in accordance with some embodiments. By virtue of this configuration, bolt carrier 610 may be made to move in tandem with operating rod 500; that is, rearward travel of operating rod 500 may cause rearward travel of bolt carrier 610, and forward travel of operating rod 500 may cause forward travel of bolt carrier 610, in accordance with some embodiments. Also, as can be seen, operating rod 500 may be operatively coupled with one or more recoil spring(s) 630 which tend to bias operating rod 500 forward towards gas block 100. As can be seen further, and in accordance with some embodiments, operating rod 500 may include a recessed portion 510 at its forward end that is configured, for example, to physically interface with piston 200, as discussed herein.

The dimensions (e.g., length, width/diameter, height, mass, etc.) of operating rod 500 can be customized for a given target application or end-use. In some embodiments, operating rod 500 may have a total length, for example, in the range of about 1.5-3.0 inches (e.g., about 1.75-2.5 inches, or any other sub-range in the range of about 1.5-3.0 inches). It should be noted, however, that an operating rod 500 of greater and/or lesser length can be provided as desired, in accordance with other embodiments.

Also, the geometry of operating rod 500 can be customized as desired for a given target application or end-use. In some embodiments, operating rod 500 can be configured, for example, with a generally L-shaped geometry, which allows operating rod 500 to be vertically offset from bolt carrier 610. As will be appreciated in light of this disclosure, it may be desirable, in some instances, to ensure that any lateral offset between the centerline of operating rod 500 and the centerline of bolt carrier 610 and barrel 400 is minimized or otherwise within a suitable tolerance.

Furthermore, operating rod 500 can be constructed from any suitable material(s). For example, in some embodiments, operating rod 500 can be constructed from a stainless steel. In some other embodiments, operating rod 500 can be constructed, for example, from a metal injection molding (MIM) material, such as S7 steel. As will be appreciated in light of this disclosure, it may be desirable in some instances to ensure that operating rod 500 comprises a material (or combination of materials), for example, which is corrosion-resistant, reliable over a large temperature range (e.g., −50° F. to 170° F.), and/or resistant to deformation, fracture, and/or cyclic fatigue (e.g., heat-treated). In a more general sense, operating rod 500 can be constructed from any suitable material which is compliant, for example, with United States Defense Standard MIL-W-13855 (Weapons: Small Arms and Aircraft Armament Subsystems, General Specification For). Other suitable configurations for operating rod 500 will depend on a given application and will be apparent in light of this disclosure.

In some cases, bolt carrier 610 can be a bolt carrier that is configured as traditionally done, as will be apparent in light of this disclosure. However, the present disclosure is not so limited, as in some other cases, bolt carrier 610 may be configured as a non-traditional and/or custom bolt carrier, as desired for a given target application or end-use. In some cases, bolt 620 may be configured to rotate, at least in part, within bolt carrier 610. Other suitable configurations for bolt carrier 610 and bolt 620 will depend on a given application and will be apparent in light of this disclosure.

System Operation

Figure 3A:
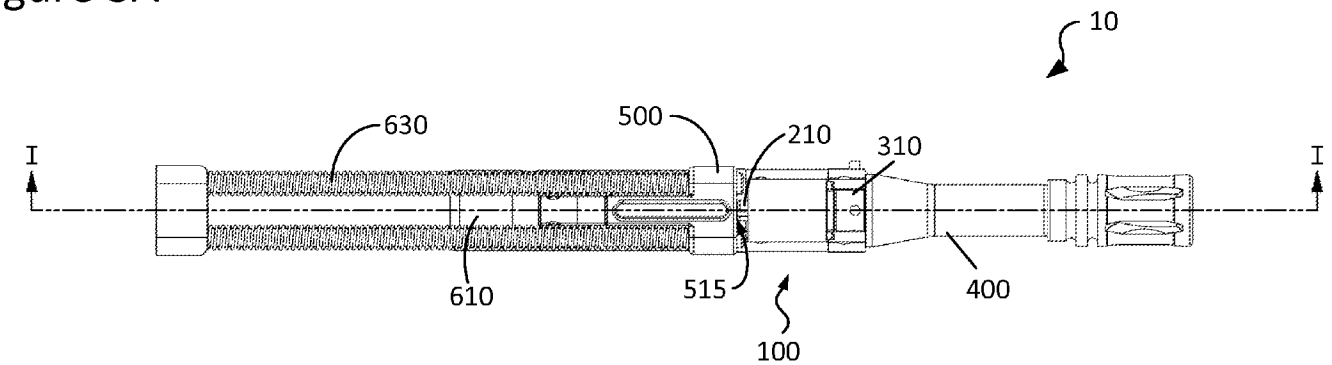
FIG. 3A is a top view of a gas operating system in the ready-to-fire state, in accordance with an embodiment of the present disclosure.
Figure 3B:
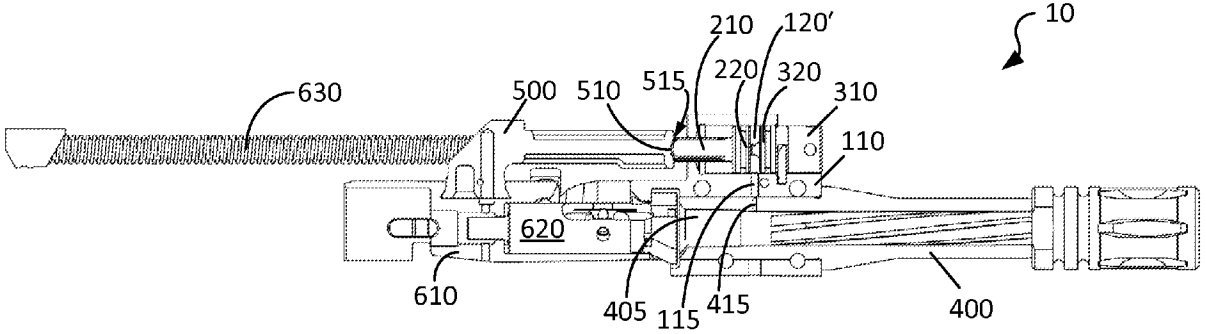
FIG. 3B is a cross-sectional view of the gas operating system of FIG. 3A taken along line I-I therein.

FIGS. 3A and 3B illustrate gas operating system 10 in the ready-to-fire state, in accordance with an embodiment of the present disclosure. As can be seen here, operating rod 500 is biased into its fully forward position by one or more recoil springs 630, and piston 200 is in its fully forward position within piston cylinder 120', adjacent to valve 320. As can be seen further, in the ready-to-fire state, an initial gap 515 remains between operating rod 500 and piston body 210. In some cases, initial gap 515 may be in the range of about 1-5 mm (e.g., about 1-3 mm, about 3-5 mm, or any other sub-range in the range of about 1-5 mm). It should be noted, however, that an initial gap 515 of greater and/or smaller size can be provided for as desired, in accordance with other embodiments.

Figure 4A:
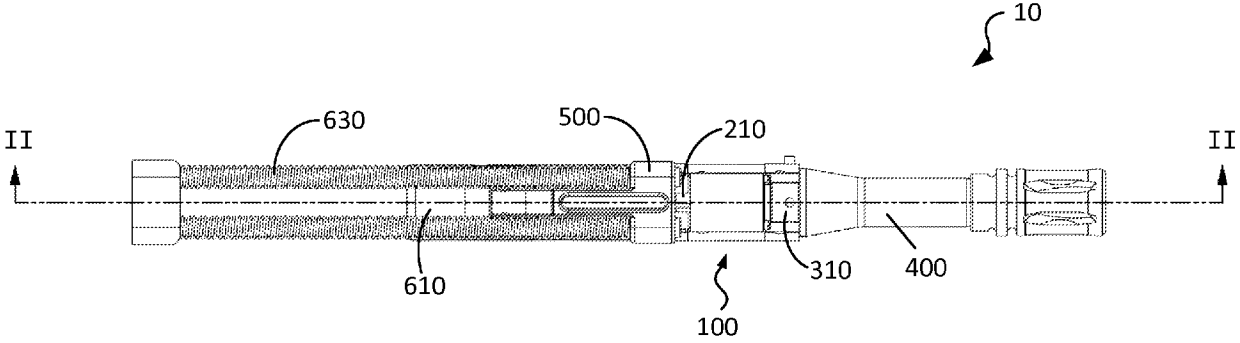
FIG. 4A is a top view of a gas operating system after discharge of a chambered pistol cartridge and at the moment of contact between the piston and the operating rod, in accordance with an embodiment of the present disclosure.
Figure 4B:
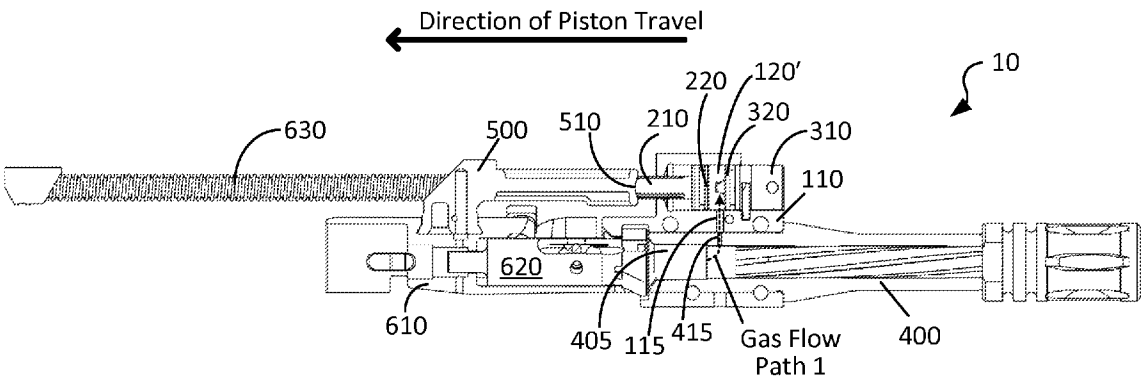
FIG. 4B is a cross-sectional view of the gas operating system of FIG. 4A taken along line II-II therein.

FIGS. 4A and 4B illustrate gas operating system 10 after discharge of a chambered pistol cartridge and at the moment of physical contact between piston 200 and operating rod 500, in accordance with an embodiment of the present disclosure. After firing of the host firearm, a volume of high-pressure gas exits bore 405 of barrel 400 through gas port 415 and is diverted to piston cylinder 120' via passageway 115, as is generally depicted by the dashed arrow labeled 'Gas Flow Path 1' in the figures. The high-pressure gas impinges on piston head 220, forcing piston 200 rearward within piston cylinder 120'. Guided in part by aperture 125 (FIG. 2B) of gas block 100, piston 200 travels rearward in a substantially linear manner. As piston 200 moves rearward, the rearward end of piston body 210 is brought into physical contact with operating rod 500 at its recessed surface 510, closing the initial gap 515 between piston 200 and operating rod 500. Thereafter, as piston 200 continues to move rearward within piston cylinder 120', operating rod 500 and the attached bolt carrier 610 are forced rearward.

Figure 5A:
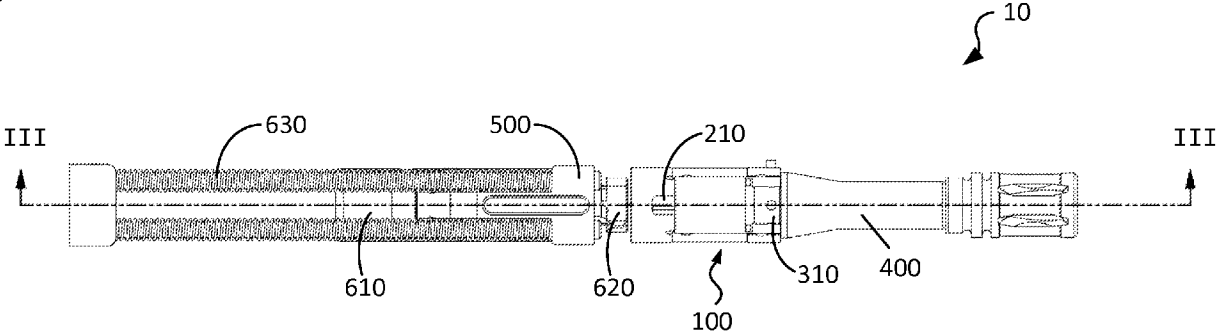
FIG. 5A is a top view of a gas operating system in an intermediate state of partial recoil, in accordance with an embodiment of the present disclosure.
Figure 5B:
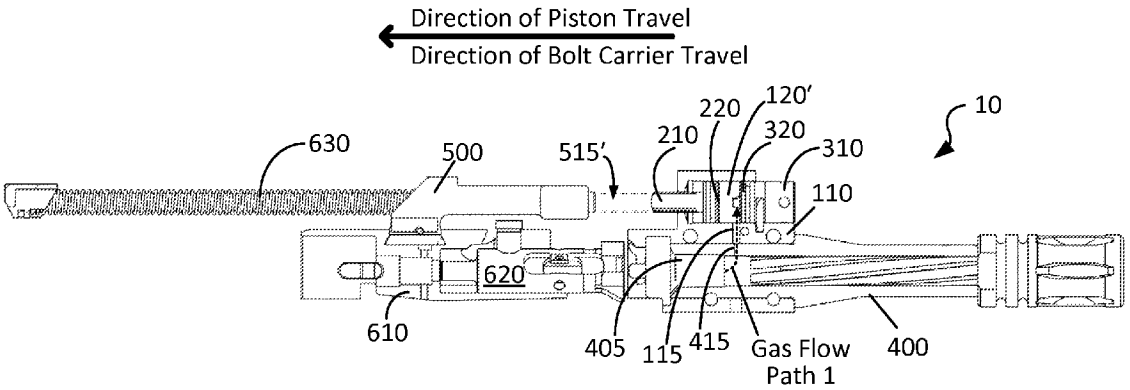
FIG. 5B is a cross-sectional view of the gas operating system of FIG. 5A taken along line III-III therein.

FIGS. 5A and 5B illustrate gas operating system 10 in an intermediate state of partial recoil, in accordance with an embodiment of the present disclosure. After a short distance of rearward travel (e.g., about 1-4 mm) from its fully forward position, operating rod 500 over-accelerates as compared to piston 200, taking piston body 210 and recessed surface 510 out of physical contact with one another, resulting in a new gap 515' between piston 200 and operating rod 500. As operating rod 500, and thus attached bolt carrier 610, continue to travel rearward, the action of the host firearm is opened, allowing for extraction and ejection of the spent cartridge case and cocking of the firearm's hammer/striker (e.g., for a subsequent firing cycle, if desired).

Figure 6A:
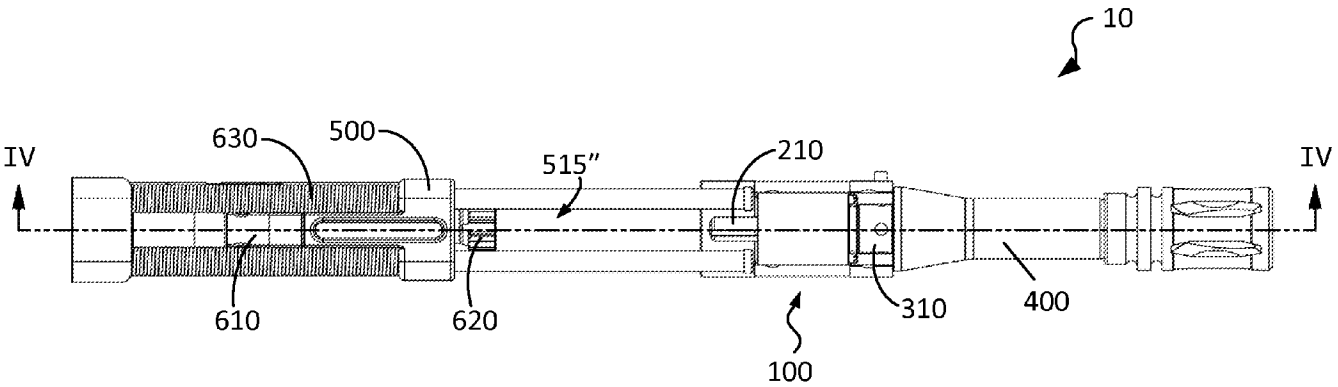
FIG. 6A is a top view of a gas operating system in its full recoil state, in accordance with an embodiment of the present disclosure.
Figure 6B:
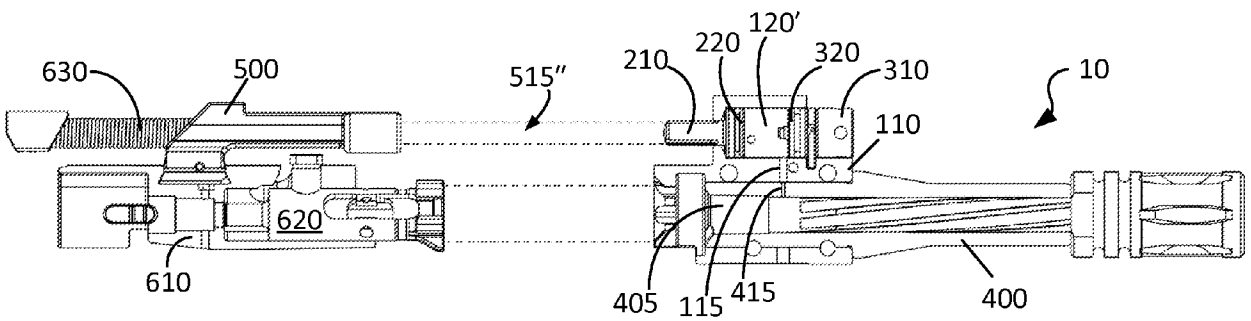
FIG. 6B is a cross-sectional view of the gas operating system of FIG. 6A taken along line IV-IV therein.

FIGS. 6A and 6B illustrate gas operating system 10 in its full recoil state, in accordance with an embodiment of the present disclosure. Piston 200 continues to move rearward until its stroke length is exhausted (i.e., until piston head 220 is arrested by aperture 125 and piston 200 stops in its fully rearward position). Also, as can be seen, operating rod 500, and thus attached bolt carrier 610, continue to travel rearward until their rearward motion is arrested by the restoring force of the one or more recoil springs 630 of the host firearm (i.e., until operating rod 500 and attached bolt carrier 610 stop in the full recoil position). During its rearward travel, gap 515' may continue to increase in size, resulting in a gap 515" between piston 200 and operating rod 500. In some cases, gap 515" may be in the range of about 2-5 inches (e.g., about 2-4 inches, about 3-5 inches, or any other sub-range in the range of about 2-5 inches). It should be noted, however, that a gap 515" of greater and/or smaller size can be provided for as desired, in accordance with other embodiments.

Figure 7A:
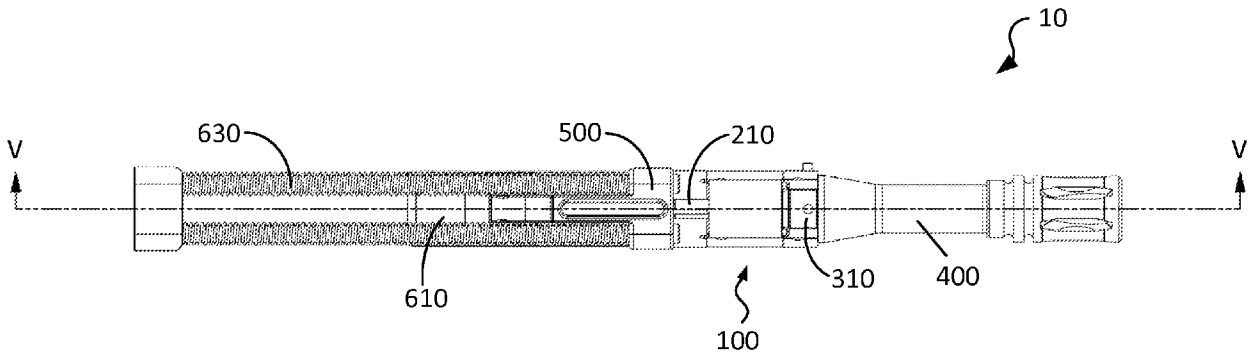
FIG. 7A is a top view of a gas operating system during the return trip to the ready-to-fire state at the moment that physical contact between its piston and its operating rod is reestablished, in accordance with an embodiment of the present disclosure.
Figure 7B:
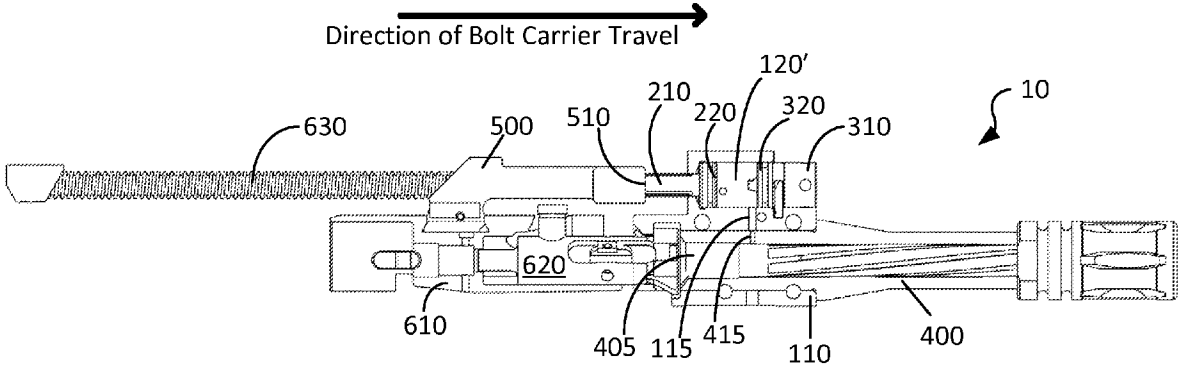
FIG. 7B is a cross-sectional view of the gas operating system of FIG. 7A taken along line V-V therein.

FIGS. 7A and 7B illustrate gas operating system 10 during the return trip to the ready-to-fire state at the moment that physical contact between its piston 200 and its operating rod 500 is reestablished, in accordance with an embodiment of the present disclosure. After reaching full recoil, the restoring force of the one or more recoil springs 630 of the host firearm drives operating rod 500, and thus attached bolt carrier 610, forward, thereby allowing for chambering of a fresh cartridge and closing of the action of the host firearm. As operating rod 500 moves forward, its recessed surface 510 is again brought into physical contact with piston body 210, closing the gap 515" between piston 200 and operating rod 500.

Figure 8A:
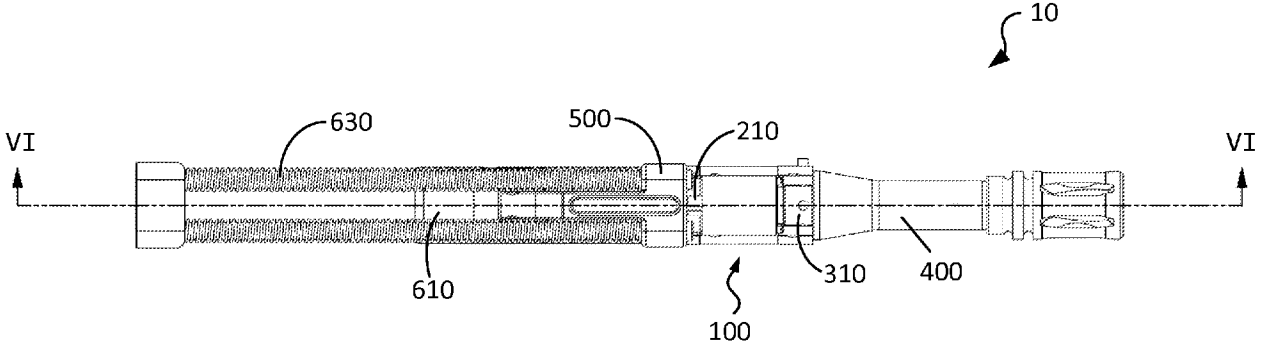
FIG. 8A is a top view of a gas operating system as it returns to the ready-to-fire state, in accordance with an embodiment of the present disclosure.
Figure 8B:
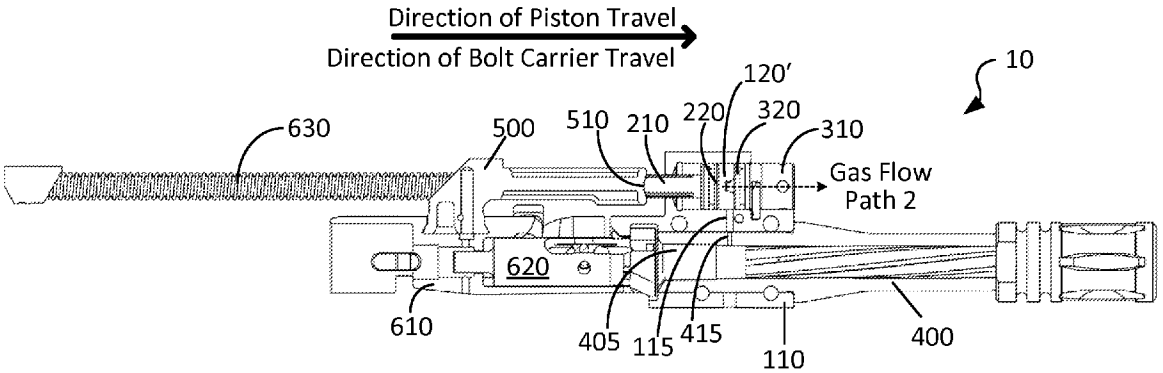
FIG. 8B is a cross-sectional view of the gas operating system of FIG. 8A taken along line VI-VI therein.

FIGS. 8A and 8B illustrate gas operating system 10 as it returns to the ready-to-fire state, in accordance with an embodiment of the present disclosure. As operating rod 500 and attached bolt carrier 610 travel forward, piston 200 is driven forward within piston cylinder 120' by operating rod 500. Guided in part by aperture 125 (FIG. 2B) of gas block 100, piston 200 travels forward in a substantially linear manner. As piston 200 moves forward during its return stroke, the gas volume within piston cylinder 120' is compressed and forced through valve 320 and may be vented, for example, to the ambient environment, as is generally depicted by the dashed arrow labeled 'Gas Flow Path 2' in the figures. In some instances, this may help to prevent or otherwise reduce the amount of gas that is returned to barrel 400 through passageway 115 and gas port 415 (e.g., minimizing or otherwise reducing back pressure for system 10). After operating rod 500 and attached bolt carrier 610 reach their fully forward position, piston 200 continues to move forward a short distance (e.g., about 1-4 mm) until it is arrested by valve 320. Consequently, the rearward end of piston body 210 is taken out of physical contact with operating rod 500 at its recessed surface 510, and initial gap 515 (discussed above) is reestablished between piston 200 and operating rod 500. Thereafter, a subsequent firing cycle optionally may begin automatically, and gas operating system 10 again may progress through the various phases of operation discussed, for example, with respect to FIGS. 3A-8B.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A gas operating system for a pistol-caliber firearm, the system comprising:

a barrel including a breech end and a gas port, the gas port located within a region of the barrel corresponding to a peak pressure curve associated with a pistol cartridge;

a gas block disposed on the breech end of the barrel, the gas block having a piston disposed therein and configured to divert a volume of gas from the barrel of the firearm to the piston through the gas port, the volume of gas produced during discharge of the pistol cartridge chambered by the firearm; and an operating rod connected to a bolt carrier of the firearm and configured to be driven rearward by the piston upon impingement on the piston of the diverted volume of gas, wherein rearward movement of the operating rod and connected bolt carrier automatically cycles the firearm.

2. The system of claim 1, wherein the gas block is formed as a unitary component.

3. The system of claim 1, wherein the piston has a piston head diameter in a range of about 0.25-0.75 inches.

4. The system of claim 1, wherein the piston has a stroke length in a range of about 5-15 mm.

5. The system of claim 1, wherein the operating rod has a total length in a range of about 1.5-3.0 inches.

6. The system of claim 1, wherein the operating rod is vertically offset from the bolt carrier.

7. The system of claim 1 further comprising a gas regulator configured to adjust a flow of the diverted volume of gas from the barrel to the piston.

8. The system of claim 7, wherein the gas regulator comprises a one-way/check valve.

9. The system of claim 1, wherein the barrel of the firearm has a length in a range of about 4-10 inches.

10. The system of claim 1, wherein the firearm is chambered for at least one of 9 mm caliber rounds, .357 SIG caliber rounds, and .40 caliber (10×22 mm) rounds.

11. The system of claim 1, wherein the volume of gas is less than that produced by an assault rifle cartridge.

12. The system of claim 1, wherein the firearm comprises a submachine gun.

13. A gas operating system for automatic cycling of a pistol-caliber firearm, the system comprising:

a barrel including a breech end;

a gas block disposed on the breech end of the barrel, the gas block comprising:

a body portion;

a lower channel formed in the body portion and configured to receive the barrel of the firearm;

an upper channel formed in the body portion and positioned above the lower channel, the upper channel having a piston disposed therein; and a gas flow path configured to provide fluid communication between the lower and upper channels, the gas flow path includes a gas port located within a region of the barrel corresponding to a peak pressure curve associated with a pistol cartridge; and an operating rod connected with a bolt carrier of the firearm and configured to be incident with the piston, the bolt carrier includes a bolt configured to rotate within the bolt carrier and engage the gas block;

wherein the system is configured to divert gas from the barrel of the firearm along the gas flow path to impinge on the piston, thereby driving the operating rod and connected bolt carrier rearward to cycle the firearm.

14. The system of claim 13, wherein the gas flow path is provided at a location with respect to the gas block which corresponds with a pressure curve peak associated with at least one of a 9 mm caliber cartridge, a .357 SIG caliber cartridge, and a .40 caliber (10×22 mm) cartridge.

15. The system of claim 13, wherein the gas flow path is provided at a location with respect to the gas block that is in a range of about 1-10 mm from a case mouth of a pistol cartridge chambered by the firearm.

16. The system of claim 13, wherein the gas flow path comprises a passageway formed in the body portion of the gas block and aligned with the gas port formed in a sidewall of the barrel received by the firearm.

17. The system of claim 16, wherein the passageway has a width or diameter that is greater than or equal to a width or diameter of the gas port.

18. The system of claim 16, wherein the gas port has a width or diameter in a range of about 0.75-2.0 mm.

19. The system of claim 13, wherein the system further comprises a valve disposed within the upper channel, the valve configured to vent to a surrounding environment during a return stroke of the piston.

20. An automatic pistol-caliber firearm comprising:

a barrel having a gas port, the gas port located within a region of the barrel corresponding to a peak pressure curve associate with a pistol cartridge;

a bolt carrier including a rotating bolt disposed therein; and a gas operating system comprising:

a gas block receiving a breech end of the barrel and the rotating bolt of the bolt carrier, the gas block having a passageway formed therein which aligns with the gas port of the barrel to provide a gas flow path from the barrel to a piston disposed within the gas block along the gas flow path; and an operating rod connected with the bolt carrier and configured to transfer a force of a gas volume impinging on the piston to the bolt carrier to automatically cycle the firearm.

21. The firearm of claim 20, wherein the firearm comprises a submachine gun chambered for at least one of 9 mm caliber rounds, .357 SIG caliber rounds, and .40 caliber (10×22 mm) rounds.

22. The firearm of claim 20, wherein the barrel has a length in a range of about 4-10 inches.

23. The firearm of claim 20, wherein the gas port is formed within a barrel extension of the barrel, the barrel extension configured to be inserted within the gas block.

* * * * *